US006098214A

United States Patent [19]

Seiber

[11] Patent Number: 6,098,214

[45] Date of Patent: Aug. 8, 2000

[54] WILDERNESS PLUMBING

[76] Inventor: Don W. Seiber, 11545 Yarnall Rd., Knoxville, Tenn. 37932

[21] Appl. No.: 09/198,305

[22] Filed: Nov. 23, 1998

Related U.S. Application Data

[63] Continuation-in-part of application No. 08/826,952, Apr. 8, 1997, abandoned.

[51] Int. Cl.[7] ..... A47K 3/22

[52] U.S. Cl. ..... 4/602

[58] Field of Search ..... 4/599, 602, 603; 126/344

[56] References Cited

U.S. PATENT DOCUMENTS

| | | | |
|---|---|---|---|
| 1,844,038 | 2/1932 | Hooker | 4/602 X |
| 3,246,644 | 4/1966 | Peterson | 224/153 X |
| 3,391,409 | 7/1968 | Gatley | 4/602 |
| 5,417,201 | 5/1995 | Thomas et al. | 126/344 |

FOREIGN PATENT DOCUMENTS

| | | | |
|---|---|---|---|
| 0161320 | 3/1904 | Germany | 4/603 |
| 0103407 | 4/1923 | Switzerland | 4/602 |

*Primary Examiner*—Charles E. Phillips

[57] ABSTRACT

A self-contained, portable, water heating system, adjustable in temperature comprising two duel use water proof bags, two water lines, a heater core and a shower head. The bags consists of a draw strap, a zipper, a rain flap, two flow valves each, one valve located on the bottom of the bags and one valve nearer the middle of the bags, a filler cap located on the top of the bags with an integrated air valve and grommets along the top of the bags. The bags are capable of having their forms altered to act as storage bags during transport containing all system components and other equipment; then to another form for use as water reservoirs. The bags are equipped with a zipper each by which this process is achieved. The water lines are equipped with mechanical fitting on either end by which all components are attached and detached. The two water lines connect one bag in reservoir form to the heater core. The heater core consists of three separate elliptical shaped loops of hollow metal tubes. The ends of the loops are joined together into a larger hollow metal tube at either end of the loops that represent an inlet and outlet for the water. When one bag is filled with water and hung in the air around waist high, one water line is connected to the middle flow valve on the bag and then to the top heater core outlet, the other water line is connected to the bottom flow valve on the bag and then to the bottom heater core inlet both flow valves are opened and the system is ready for operation. Through gravity action the water lines and heater core are filled with water and the heater core is then placed into direct contact with any exposed heat source. When the water in the heater core becomes hot it expands creating pressure which forces water to flow in the path of least resistance which is through the upper water line and back into the bag. This water is then replaced with cooler water from the bag through the bottom water line and the cycle continues as a constant flow until the water in the bag is thoroughly heated.

6 Claims, 6 Drawing Sheets

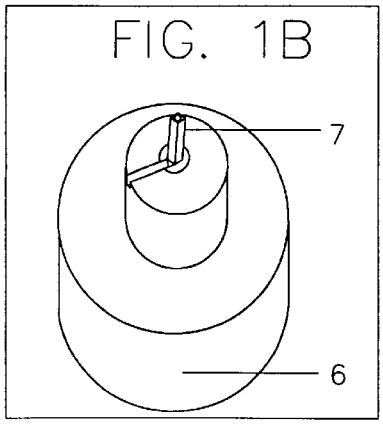
FIG. 1A
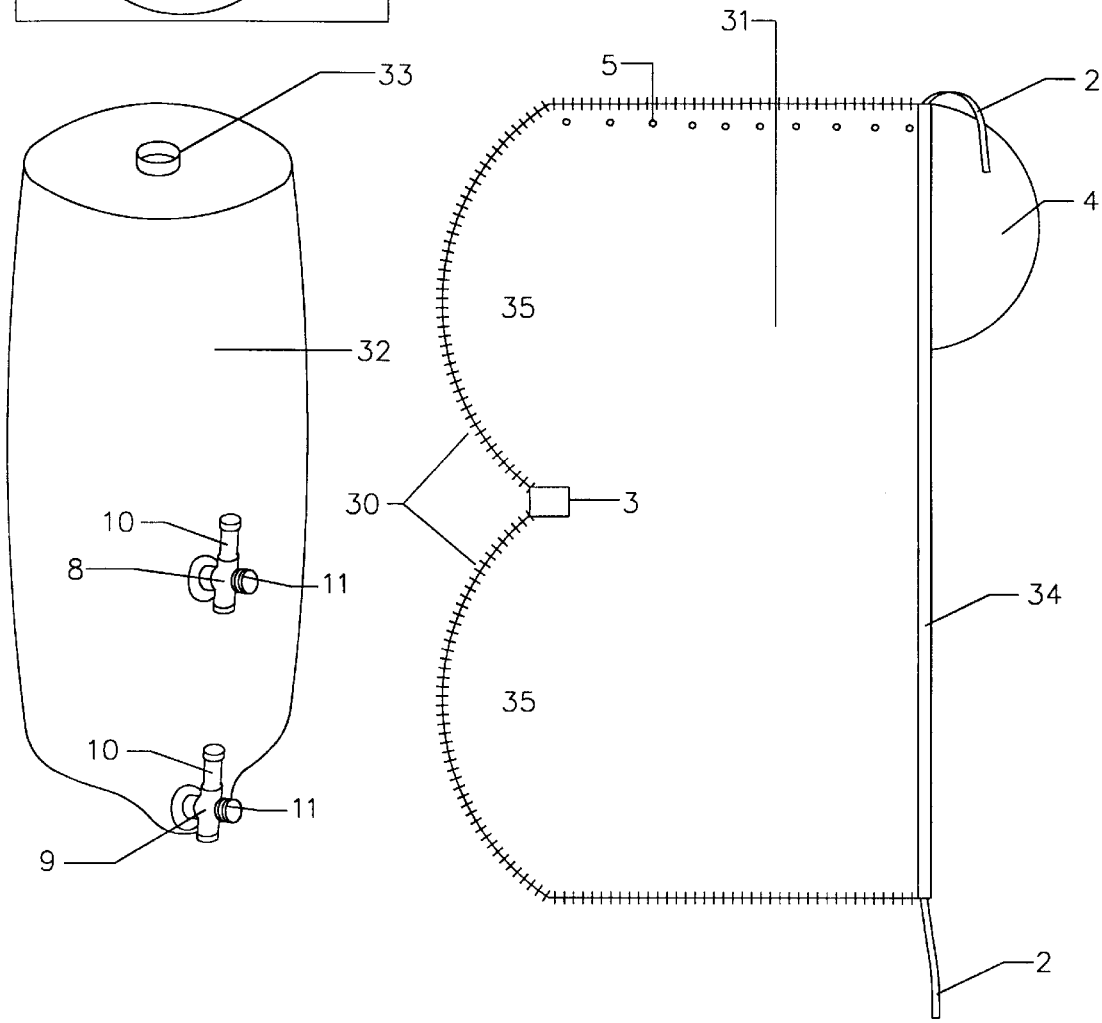

WILDERNESS PLUMBING

This is a continuation-in-part of Ser. No. 08/826,952 filed on Apr. 8, 1997, now abandoned.

BACKGROUND OF THE INVENTION

1. Field of Invention

This invention relates to a device that provides both hot and cold running water that is adjustable in temperature, to the desires of the user, in remote areas where utilities are not available. More specifically to a device that is capable of being self-contained so as to be easily portable and specifically designed to serve as a cargo vessel for other, unrelated equipment such as camping gear.

| References Cited | | |
|---|---|---|
| | U.S. Pat. Documents | |
| 3,391,409 | Leonard C. Gatley | 1968 |
| 1,844,038 | B. R. Hooker | 1932 |
| 3,246,644 | C. F. Peterson | 1966 |
| 5,417,201 | Thomas et al. | 1995 |
| | Foreign Patent Document | |
| 103407 | Maurice Abetel Swiss | 1923 |

2. Prior Art

In U.S. Pat. No. 3,391,409 is seen a collapsible shower structure, constructed of tubular type bars which form a square structure, with an elevated vessel to dispense water and a curtain to provide privacy, that maybe disassembled and relocated. In U.S. Pat. No. 1,844,038 is seen a portable shower stall, the top of this structure is round and has a curtain around its perimeter, in the center is one vessel divided in half so it has two areas for water. The top of this structure is supported by three legs made of segmented members attached through the means of a sleeve, held in place by a set screw. The bottom of the stall is represents by a "D" shaped tub. When the apparatus is disassembled it is placed within this "D" tub to be carried. In U.S. Pat. No. 3,246,644 is seen a device that heats water. This device is a single steel tube, bent to the desired configuration attached to metal members that serve as braces. These braces make allowances and serve as mounts for straps so that this device may be worn on the back like a backpack. The bent tube is placed in a fire to heat water. At one end of the tube is a check valve which allows water to move in only one direction. This portable water heater uses a rectangular shaped metal box to hold water. This box is placed on the ground during a heating process. This arrangement sets forth no discernible way to retrieve the heated water from the metal container in a convenient manner. In U.S. Pat. No. 5,417,201 is seen a portable water heating system which also uses a single stainless steel tube to heat water. This heating system uses a preexisting vessel that has been retrofitted as a reservoir. The vessel is placed on the ground during a heating process. After water is heated in the tube, it returns to the reservoir through a device which floats freely within the reservoir. The retrofit includes a device that allows one to retrieve water; hot, cool or a combination of both from the same vessel during the heating process.

The present water system Wilderness Plumbing uses two reservoirs, one hot and one cold, the hot reservoir is suspended in the air during the heating process enhancing the natural properties by which the system functions. These reservoirs are designed to physically alter form, specifically to become and serve as transport devices for components of this system and particularly for unrelated equipment such as clothes and sleeping bag used by campers. The heater core of the present system incorporates three aluminum tubes which increase the ratio of surface area to volume of water increasing efficiency. Additionally the present heater core has provisions that reduce the interference of steam inherent to these types of systems.

Although U.S. Pat. Nos. 3,246,644 5,417,201 and the present system heats water in similar ways the devices themselves and designs vary, including efficiency and convenience. To the best of the inventors knowledge, none of the above or any other share the present design or characteristics.

BRIEF SUMMARY OF INVENTION

It is the object of the present invention to provide a water heating system for what ever purpose one desires, which is adjustable in temperature to the desire of the user.

It is a further object to provide a system that is completely portable, being self contained and capable of carrying other equipment, such as clothes/sleeping bag.

It is a further object of this invention to provide a system that is rugged, simple to operate and adaptable to the wilderness or any-where an exposed heat source is present or can be taken.

The water system of the present invention comprises of two dual use bags, two water lines, a heater core and a shower head. Both bags utilize a zipper to alter their form so they may serve two functions. During transport, the bags are in a configuration that resembles and functions as a common stuff sack, so they can contain all system components as-well-as other equipment such as clothes/sleeping bag and any article of such size that may fit within them. After arriving at the destination of choice, the bags are emptied and unzipped to reveal their resevoir forms that are used to contain water for use in the water system.

One bag after being filled with water though a filler cap located at the top, is hung in the air around waist high; and connected to the heater core by the two water lines. The connection points on the bag, one at the bottom and one nearer the middle, comprises on/off flow valves. The two water lines are mechanically connected to the flow valves and then are mechanically connected to the heater core. Once the flow valves are opened, gravity fills the water lines and heater core with water, then the heater core is introduced into direct contact with any exposed heat source. Once the water in the heater core begins to increase in temperature the water expands and begins to flow though the lines in the path of least resistance which leads through the top line and back into the bag. This water is replaced by cooler water from the bag through the bottom line and the process continues until the water in the bag is thoroughly heated. During the heating process steam is created building pressure within the bag that is relieved at the top. The filler cap at the top of the bag comprises of an air valve which allows the steam to escape the bag. After the water is thoroughly heated the heater core is removed from the heat source, the flow valves are closed and the heater core is disconnected.

One bag now contains hot water and the second bag contains water of natural temperature, (cold). Both bags are then connected to the shower head by use of the same two water lines. Each water line connected to one bag at the bottom flow valve on one end and to the shower head at the other end. The bottom flow valves where the water lines are now connected to the bags are then opened. The two bags are then hung in the air side-by-side. The shower head comprises of a valve which controls the water flow on/off and controls the temperature of the water ejected to the desires of the user. As water is drained from the bags the air valve at the top of the bag allows air to enter the bags to increase water flow.

BRIEF DESCRIPTION OF THE DRAWINGS

FIG. 1A shows components of the dual use bags.

FIG. 1B shows an enlarged view of a filler cap.

FIG. 2 C, is a perspective view of one dual use bag, that illustrates the bag's form as it would be used as a water reservoir.

DETAILED DESCRIPTION OF THE PREFERRED EMBODIMENTS

Figure 2A:
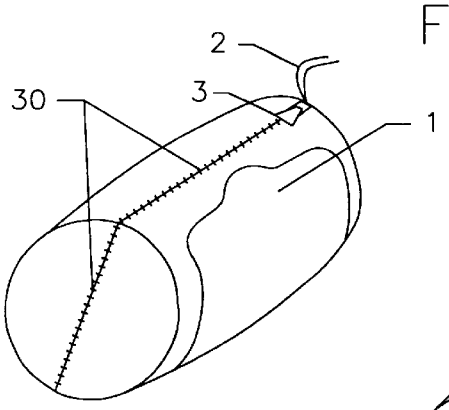
FIG. 2A, is a perspective view of one dual use bag, that illustrates the bag's cargo form as it would be used as a transport device.

The present water system, as described herein is adjustable in temperature, containing both hot and cold attributes; it is self contained, so as to be portable and designed to carry unrelated items, such as clothes and sleeping bag for camping. This system comprises two dual use bags, two water lines, a heater core and a shower head, each as described in detail herein. The two dual use bags of the present system are identical, therefore to describe one is to describe both; thus, one bag is described as it would be constructed in FIGS. 1, A and B.

Referring now to the drawings in detail, as seen in FIG. 1A, are components of an entity, that when constructed will be one of two "dual use bags" defined in name, herein as "bag" which is described in further detail after it's construction is set forth. The "bag" entity may be constructed by affixing together, two layers of nylon material members (31), by such means as a heat resistant glue. The nylon material members (31) should be about 39 inches long from top to bottom. The nylon material members (31) should be of such shape and size as to later form a cylindrical shaped entity, similar to that of a common stuff sack; large enough to comfortably accommodate an average size adult sleeping bag. For example, said shape could be 20 inches in diameter and be 22 inches in length also possessing the following refinements as described herein. Said cylindrical shape is illustrated and described in detail later. Sandwiched between the material members (31), should be a water proof polypropylene bladder (32) about 12 mill in thickness, used to contain water. The bladder (32) should be sufficient in size to accommodate 7–9 gallons of water, for example being 15 inches in width, when laid flat as it would be glued between the material members (31) during manufacture. The bladder (32) should be about 36 inches long from top to bottom and of desired shape. An upper valve body (8) and a lower valve body (9), should be made of a medium density polypropylene and manufactured on to the bladder (32). Both the upper and lower valve bodies (8) and (9) respectively protrude through the affected material member (31) so as to be exposed. Both the upper and lower valve bodies (8) and (9) respectively should provide a ⅜ inch diameter passageway for water to pass through and should be made to receive ⅜ inch push valves (10), known to those familiar in the art. Both the upper valve body (8) and the lower valve body (9) includes fittings (11) which are threaded mechanical fittings similar to a garden hose known to those familiar in the art. The upper valve body (8) is located about 11 inches above the lower valve body (9) which is located nearest the bottom of the bladder (32). Manufactured on to the bladder (32) nearest the top should be a cap seat (33) made of a medium density polypropylene, that also protrudes through the affected material member (31). The cap seat (33) is a tub type structure of such thickness as to accept pipe type threads along its outer perimeter so as to receive a filler cap that is described in detail later. The cap seat (33) should be about 1 inch high and provide a passageway no smaller than 2½ inches in diameter for water to pass through. As seen, in FIG. 1B, is a filler cap (6), which has been enlarged for viewing. The filler cap (6) made of medium density polypropylene should have pipe type threads along its inner perimeter, and should be threaded, so as to receive the cap set (33). The filler cap (6) comprises an integrated air valve (7) which is a flip-type valve similar to what is found on shampoo bottles, known to those familiar in the art. The air valve (7) provides a 1/16 inch diameter passageway for air to pass through, this is described in detail later. There should be a sleeve like opening (34) about 1 inch wide between the material members (31). The sleeve like opening (34) is a passageway between the material members (31) for a draw strap (2). The draw strap (2) is a ½ inch wide nylon strap about 48 inches long. Protruding through both of the material members (31) About 1½ inches from the top edge, should be ten ⅜ inch grommets (5). The grommets (5) and the draw strap (2) are described in further detail later. Sewn to the material members (31) on the outer most edges, of three sides, should be a zipper track (30) which is zipped together and unzipped by the zipper (3).

As the zipper (3) is used to zip together the zipper track (30), two areas (35) are drawn together forming a closed end of a now forming shape; as the zipper (3) is drawn progressively toward the opposite end of the zipper track (30) a cylinder type shape is formed. A rain flap (4) represents a flap like lid, to what would be an open end of said cylinder shape. It is within this given shape that items are placed for transport. The draw strap (2) is used to draw closed, what would be an open end of said shape, so as to contain items placed therein for transport. Said cylinder shape is illustrated and described in further detail as the reverse transforming process is seen in the following FIGS. 2, A, B, and C.

As described and manufactured above; "the constructed device," is a dual use bag referred to herein as "bag" as seen in the following illustrations of FIGS. 2, A, B and C and described in further detail.

Two dual use bags of the present system are identical, therefore to describe one is to describe both; hence, one bag is illustrated and described as plural until both are used together, which is illustrated and described in detail later.

Figure 2B:
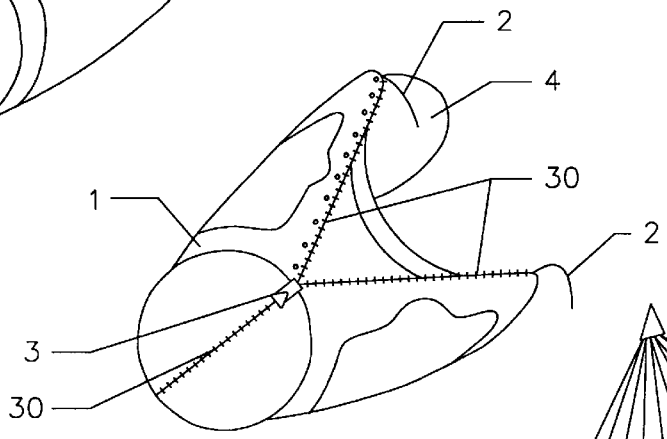
FIG. 2 B, is a perspective view of one dual use bag, that illustrates the transformation of the bag's form from a transport device to a form that serve as a water reservoir.
Figure 2C:
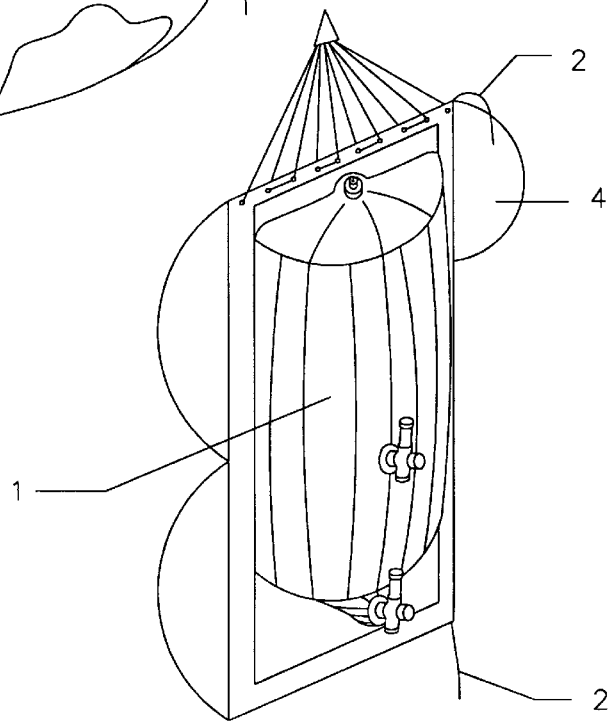

As seen in the illustrations of transformation in FIGS. 2, A, B and C, the bags (1) are capable of having there form altered to serve one function, as a transport device and a second function, as reservoirs for the water system. As seen in FIG. 2A, the bags (1) in their cargo form, both resemble and function as a common stuff sack, for use in storing for transport system components, such as water lines, heater core, and a shower head to be described in detail later, respectively. The bags (1) comprise draw straps (2). The draw straps (2) are the means by-which system components and equipment, (such as clothes/sleeping bag) are secured within the bags (1), in cargo form, for storage during transport. The bags (1) are also provided rain flaps (4) best seen in FIG. 2B. The rain flaps (4) aid in preventing rain from corrupting equipment, (such as clothes/sleeping bag) contained within the bags (1), in cargo form, during transport. The bags (1) are equipped with zippers (3) best seen in FIG. 2B. The zippers (3) are the means by-which the bags (1) alter form. The zippers (3) hold the bags (1) closed, in their cargo form seen in FIG. 2A. As the zippers (3) are used to unzip the zipper track (30); (as seen in the transformation from FIGS. 2B, to 2C) the bags (1) unroll to reveal their reservoir form seen in FIG. 2C, for use in the water system.

Figure 3:
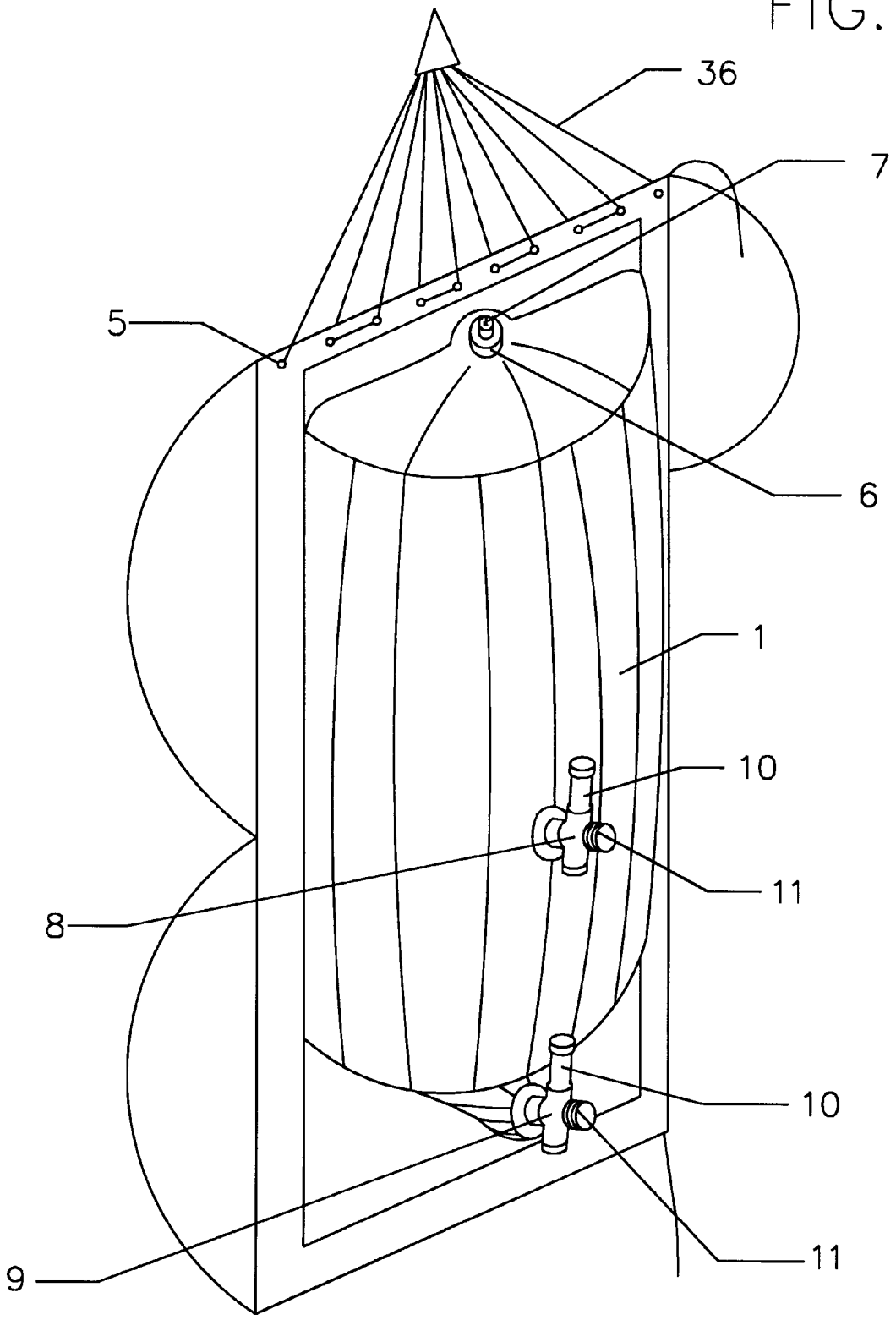
FIG. 3 a perspective view of one dual use bag, in it's reservoir form.
Figure 4A:
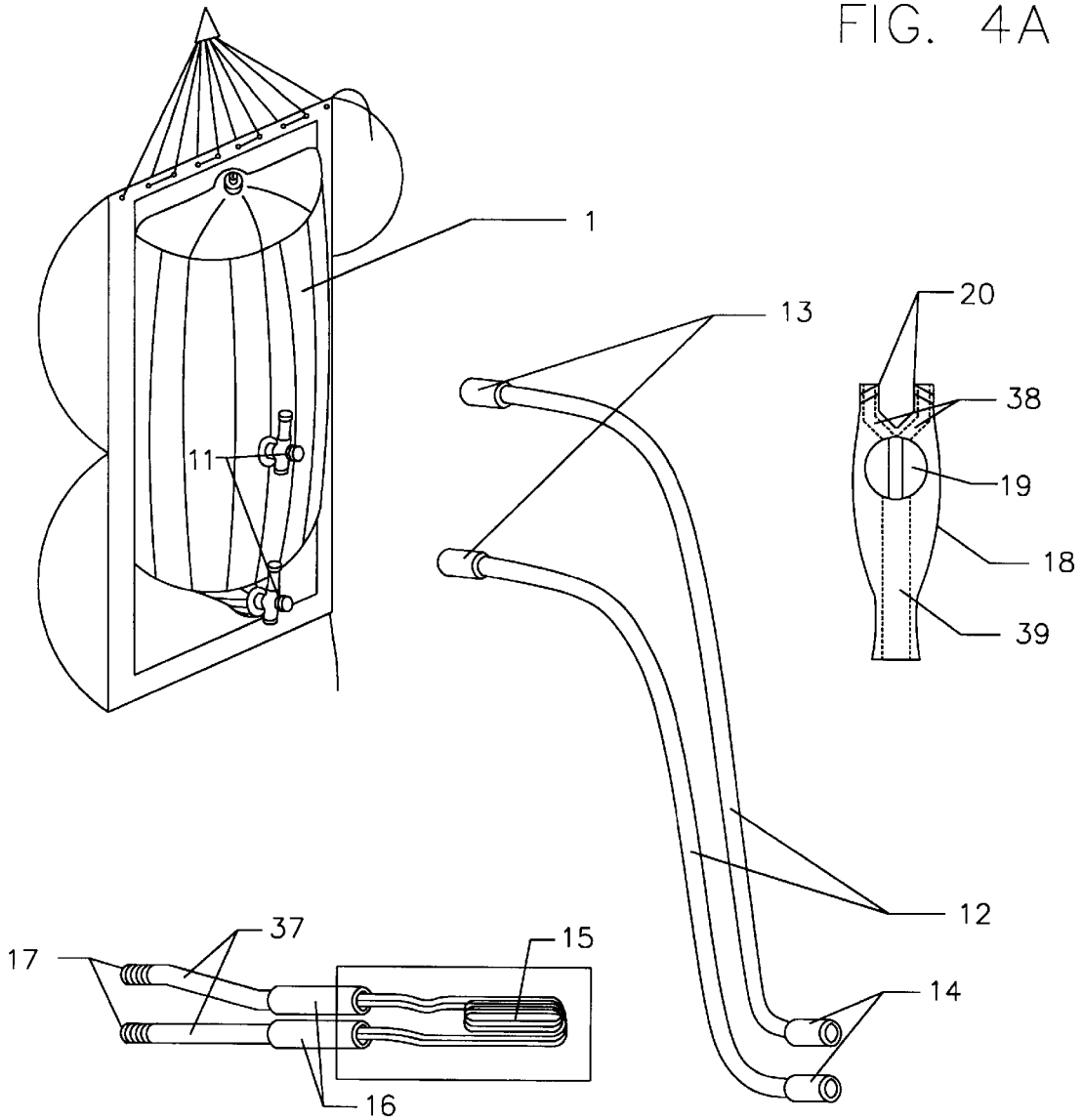
FIG. 4A shows water lines, heater core, and shower head of the present system.

As seen in FIG. 3, the bags (1) in reservoir form expose elements relative to their function in the water system. The bags (1) are constructed to contain water while in reservoir form. One of the two bags (1) would contain water that is to be heated, the second bag (1) would contain water that is not to be heated, this is described in further detail later. The bags (1) are further provided with grommets (5). The grommets (5) allow the bags (1), in reservoir form, to be suspended in the air by nylon cord (36). The bags (1) are also provided filler caps (6). The filler caps (6) are the means by which the bags (1) are filled with water. The filler caps (6) comprises integrated air valves (7). The air valves (7) are flip-type valves similar to what is found on shampoo bottles, known to those familiar in the art. The air valves (7) provide a 1/16 inch diameter passageway for air to enter and exit the bags (1) relative to use, this is described in detail later. The bags (1) are further equipped with upper and lower valve bodies (8,9), receptively. Both the upper valve body (8) and the lower valve body (9) provide a ⅜ inch diameter passageway for water to pass through. Both the upper valve body (8) and the lower valve body (9) includes valves (10). The valves (10) are simple push valves known to those familiar in the art and provides a ⅜ inch passageway for water to pass through. The valves (10) are the means by which, water within the bags (1) is retained or released relative to use, this is described in detail later. Both the upper valve body (8) and the lower valve body (9) further includes fittings (11) threaded mechanical fittings similar to a garden hose known to those familiar in the art. The fittings (11) are the entities by which the upper valve body (8) and the lower valve body (9) are mechanically connected to water lines, described in FIG. 4.

Figure 4B:
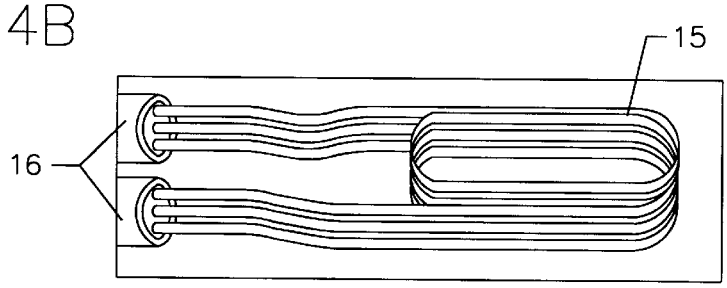
FIG. 4B shows a fragmented enlarged view of a portion of the heater core.

FIG. 4 shows water lines, heater core and a shower head. The water lines (12) are clear vinyl hoses about 42 inches long that provide a ⅜ inch passageway for water to pass through. The water lines (12) provide a passageway from one of the bags (1) to a heater core, (described in this figure), and back to the bag (1), for the purpose of heating water, this process is described in detail later. The water lines (12) also provide a passageway from both bags (1) to a shower head, (described in this figure), for the purpose of dispersing water, this process is described in detail later. The water lines (12) comprise both top and bottom fittings (13,14), respectively which are threaded mechanical fittings similar to a garden hose known to those familiar in the art. The top fittings (13) are the entities by which the water lines (12) are mechanically connected to the bags (1) by use of the fittings (11) which are of same type and thread pattern so as to receive each other. The bottom fittings (14) are the entities by which the water lines (12) are mechanically connected, (relative to use), to either a heater core or a shower head, described in this figure.

Figure 5:
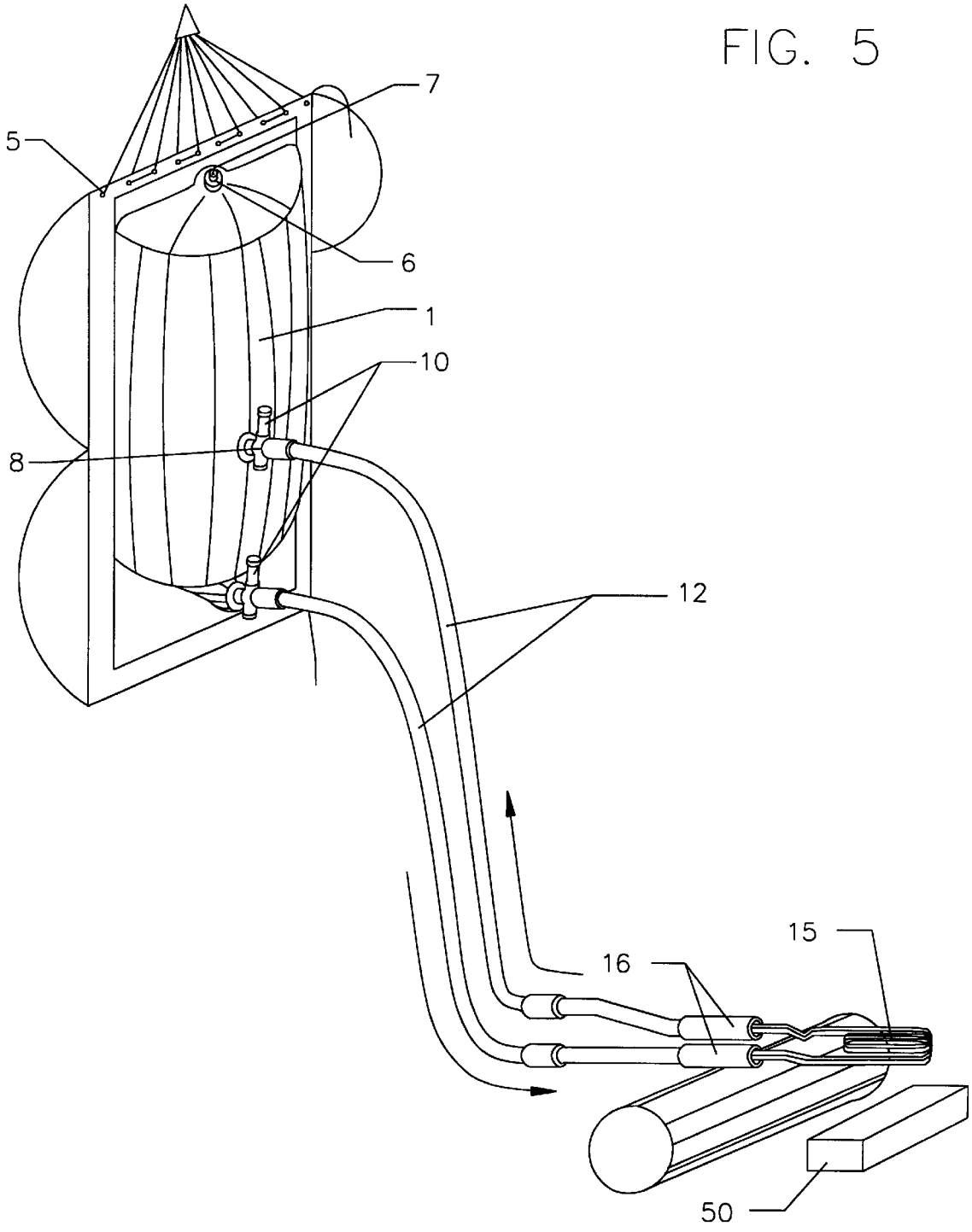
FIG. 5 is a perspective view of one of the dual use bags, both water lines and the heater core as it would be during a heating process.

The heater core (15) absorbs heat from a heat source for the purpose of heating water, this process is described in detail as seen in FIG. 5. The heater core (15) comprises three separate elliptical shaped loops of hollow aluminum tubes, (best viewed in FIG. 4A), each provide a ¼ inch diameter passageway for water to pass through and are about 21 inches in length. The heater core (15) is further provided with expansion chambers (16) which are aluminum tubes about 6 inches long, providing a ⅞ inch diameter passageway for water to pass through. The expansion chambers (16) provide an area for steam, created by a heating process to be dispersed back into the water, said heating process is described in detail as seen in FIG. 5. The heater core (15) further includes fittings (17), threaded mechanical fitting similar to a garden hose known to those familiar in the art. The fittings (17) are the entities by which the heater core (15) is mechanically connected to the water lines (12) by use of the bottom fittings (14) which are of same type and thread pattern so as to receive each other. The heater core (15) further includes aluminum tubes (37) that are about 8 inches long and provide a ⅜ inch passageway for water to pass through. The tubes (37) protect the fittings (17) from heat damage, by providing distance from a heat source.

The shower head (18) is used to disperse water, this process is described in detail later. The shower head (18) comprises a valve (19) which controls water flow as in off/on and adjusts the temperature of the water ejected. The valve (19) is a ¾ inch Valterra gate valve known to those familiar in the art. The shower head (18) also includes fittings (20), threaded mechanical fittings similar to a garden hose known to those familiar in the art. The fittings (20) are the entities by which the shower head (18) is mechanically connected to the water lines (12) by use of the bottom fittings (14), which are of same type and thread pattern so as to receive each other. The shower head (18) should be of desired shape, about 8 inches long and made of medium density polypropylene. The shower head (18) should be round and could be made as small as 1⅝ inches in diameter. The shower head (18) should provide internal passageways for water to pass through; within each of the fittings (20), should be a ⅜ inch diameter passageway (38) extending to the valve (19); there-at the passageway (39) should be ¾ inch in diameter and extend to the opposite end were water is ejected.

As seen in FIG. 5, components of the present system as they would be during a heating process. One of the two bags (1) with the valves (10) closed, is filled with water, through the means of the filler cap (6), to any level above the upper valve body (8); then suspended in the air around waist high by use of the grommets (5). The bag (1) is then connected to the heater core (15), through the use of water lines (12) as described in FIG. 4. The air valve (7) and the valves (10) are then opened. Gravity allows the water lines (12) and the heater core (15) to be filled with water. The heater core (15) is then introduced into direct contact with any exposed heat source (example, a camp stove, grill, fire, exc.). The heater core (15) transfers heat from a heat source (represented by a rectangular box (50)) to the water contained within itself. As the water within the heater core (15) is heated nearing the boiling point; the water expands, creating pressure which forces it to move in the path of least resistance, which is through the upper water line (12) and back into the bag (1). This action simultaneously creates a void within the heater core (15), which draws cooler water in, as a siphon action, from the bag (1) through the bottom water line (12) into the heater core (15), in relevant volume to the water that has been displaced. This process is then repeated and continues as a constant cycle as long as the heater core (15) is in contact with any exposed heat source (50). Steam which is created by this process interferes with the circulation of water flow. The heater core (15) is equipped with expansion chambers (16) which minimizes interference created by steam. The expansion chambers (16) provides an area, larger than that of the heater core (15), which allows steam to expand there by being dispersed throughout a larger volume of water, thus enhancing the circulation of water flow. Steam which invades the bag (1) during the heating process builds pressure that must be relieved. The air valve (7), which is integrated into the filler cap (6), provides a passageway for steam to exit the bag (1).

After water within the bag (1) has been thoroughly heated, the heater core (15) is removed from the heat source (50). The valves (10) are then closed and the heater core (15) is disconnected from the water lines (12).

Figure 6:
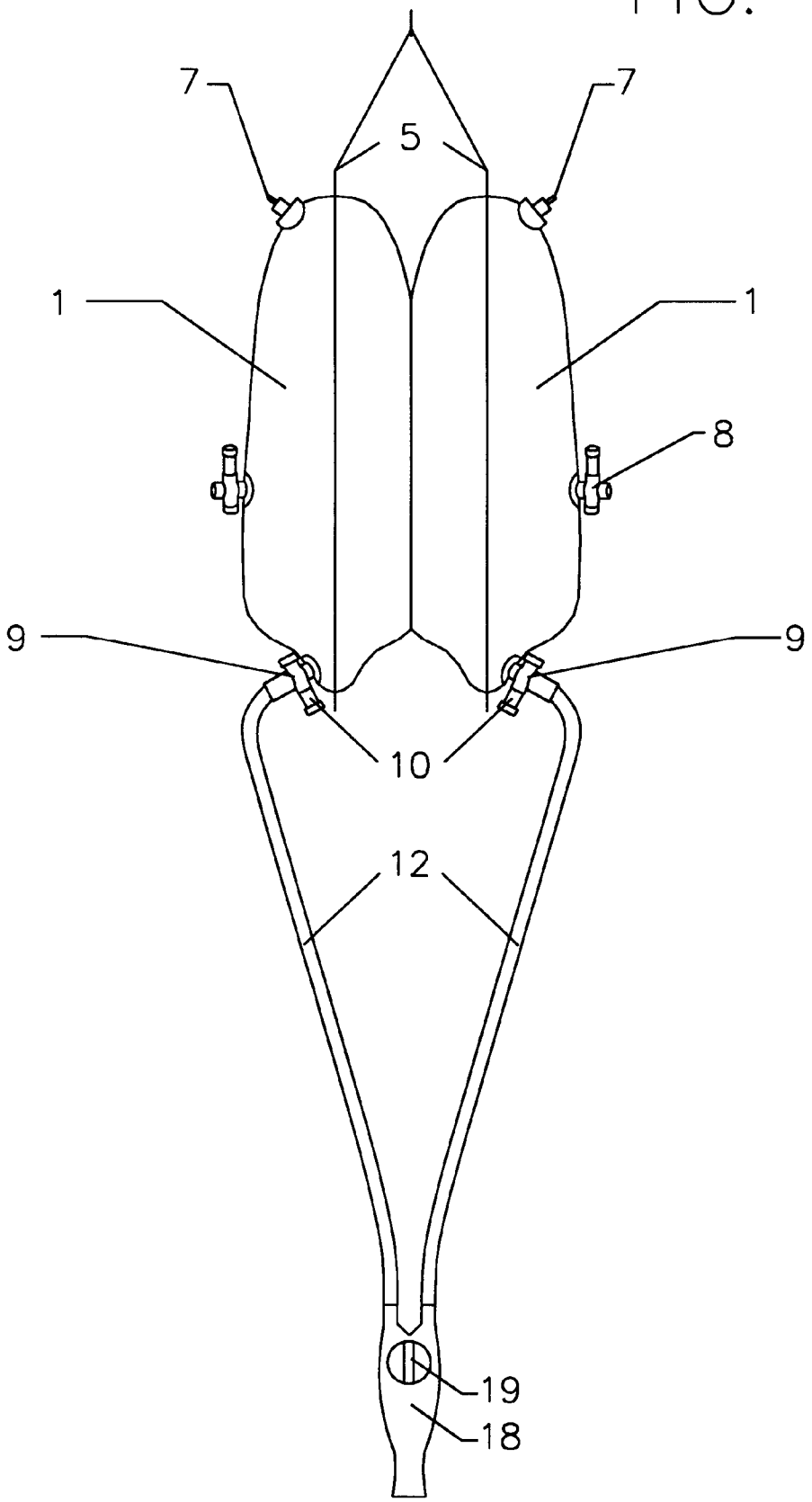
FIG. 6 shows both dual use bags, both water lines and a shower head as it would be, after the heating process, ready for use.

As seen in FIG. 6 components of the present system as they would be ready for use. The bags (1) are suspended in the air side-by-side, by use of their respective grommets (5). One of the bags (1) contains water that has been heated and the second bag (1) contains water of natural temperature, being cold. The upper water line (12) has been disconnected from the upper valve body (8) of the heated bag (1) and is mechanically connected to the lower valve body (9) of the cold bag (1). The water lines (12) are then mechanically connected to the shower head (18) as described in FIG. 4. Both air valves (7) are opened, then the valves (10) of the lower valve bodies (9) are opened. The shower head (18) comprises a valve (19). The valve (19) is the means by which the user controls the flow of water as in off/on and allows a mixture, in any ratio, of water from both bags (1) to regulate and adjust, as desired, the temperature of the water ejected. As water is drained from the bags (1), the air valves (7) provides air a passageway to enter the bags (1) there-by increasing water flow.

What is claimed is:

1. A portable shower device comprising at least two dual use bags, each bag comprising two portions being connected together by a connecting means so as to form a carrying bag structure with an open top to be used to carry articles of said shower device and outdoor components, said portions when not connected together being capable of assuming a coplanar position and having attached thereto to a bladder for containing water, said bags having a water inlet and a water outlet, means to suspend said bags in an elevated hanging position above the ground, a shower head connected to said outlet in order to dispense water to a user standing in the vicinity of said shower device for bathing, said shower head being connected to each bag, one containing heated water, said shower head having means thereon for adjusting the temperature of the water exiting said shower head when one bag contains water of a different temperature than the other.

2. The portable shower device of claim 1 further comprising a heater core having three separate elliptical shaped loops of hollow aluminum by which water is heated.

3. The portable shower device of claim 1 wherein said connecting means is a zipper.

4. The portable shower device of claim 1 wherein each bag is equipped at its open end with a draw strap and a rain flap.

5. The portable shower device of claim 1 wherein each bag is equipped with a rain flap which prevents rain from entering while in carrying bag form, during transport;

each bag is equipped with grommets by which, each is supported in the air, while in reservoir form, to allow water flow;

each bag is equipped with a filler cap by which, each bag is filled with water, while in reservoir form;

each bag is equipped with an air valve, integrated into said filler cap by which air enters and exits each bag, allowing better water flow while in reservoir form;

each bag is equipped with two valve bodies, by which water flow is controlled and water lines are attached while in reservoir form.

6. The portable shower device of claim 5 wherein the heater core comprises expansion chambers, which are area specifically designed to allow steam, created by a heating process, to be absorbed/dispersed throughout a larger volume of water, which minimizes interference to water flow created by steam, generated by a heating process.

* * * * *